United States Patent [19]

Hippely et al.

[11] Patent Number: 4,961,716

[45] Date of Patent: Oct. 9, 1990

[54] TOY APPARATUS INCLUDING ROBOTIC ARM

[75] Inventors: Keith A. Hippely, Manhattan Beach; Madhusudan Joshi, Palos Verdes Estates; Larry R. Wood, Redondo Beach, all of Calif.

[73] Assignee: Mattel, Inc., Hawthorne, Calif.

[21] Appl. No.: 151,689

[22] Filed: Feb. 2, 1988

[51] Int. Cl.[5] ..... A63H 33/00

[52] U.S. Cl. ..... 446/75; 446/426; 446/476; 414/917; 901/15

[58] Field of Search ..... 446/75, 425, 426, 424, 446/428, 423, 476; 414/917, 738, 735, 2, 8, 226; 901/15, 7, 50; 294/19.1

[56] References Cited

U.S. PATENT DOCUMENTS

| | | | |
|---|---|---|---|
| 2,286,571 | 6/1942 | Pollard | 901/7 X |
| 2,429,070 | 10/1947 | Olson . | |
| 2,563,974 | 8/1951 | Thierry . | |
| 3,594,947 | 7/1971 | Hartling et al. | 446/425 X |
| 3,911,615 | 10/1975 | Alexander . | |
| 3,955,312 | 5/1976 | Pugh . | |
| 3,997,061 | 12/1976 | Sano . | |
| 4,140,226 | 2/1979 | Richter | 414/917 X |
| 4,150,839 | 4/1979 | Tucker et al. . | |
| 4,186,517 | 2/1980 | Kuhn et al. . | |
| 4,208,830 | 6/1980 | Yoshida . | |
| 4,236,344 | 12/1980 | Kelly . | |
| 4,261,133 | 4/1981 | Hanson et al. | 446/424 X |
| 4,312,149 | 1/1982 | Iwao . | |
| 4,315,650 | 2/1982 | Yoshida . | |
| 4,316,346 | 2/1982 | Brand et al. | 446/426 X |
| 4,360,988 | 11/1982 | Schoenfield et al. | 446/424 |
| 4,507,043 | 3/1985 | Flatau . | |
| 4,626,164 | 12/1986 | Chang . | |

FOREIGN PATENT DOCUMENTS

| | | | |
|---|---|---|---|
| 3203459 | 8/1983 | Fed. Rep. of Germany | 446/426 |

*Primary Examiner*—Mickey Yu

*Attorney, Agent, or Firm*—Roy A. Ekstrand

[57] ABSTRACT

Toy apparatus in a playset including a robotic arm module for handling toy vehicles advanced along a path past a plurality of stations including a pickup station, an immersion station, and an exit station. The robotic arm module has gripper members actuatable for picking up the toy vehicle at the pickup station, then dipping the toy vehicle into a liquid and then depositing the toy vehicle at an exit station. The robotic arm apparatus is in the form of a parallelogram linkage which enables twisting action of the gripper members as well as up and down and sideways movement.

14 Claims, 4 Drawing Sheets

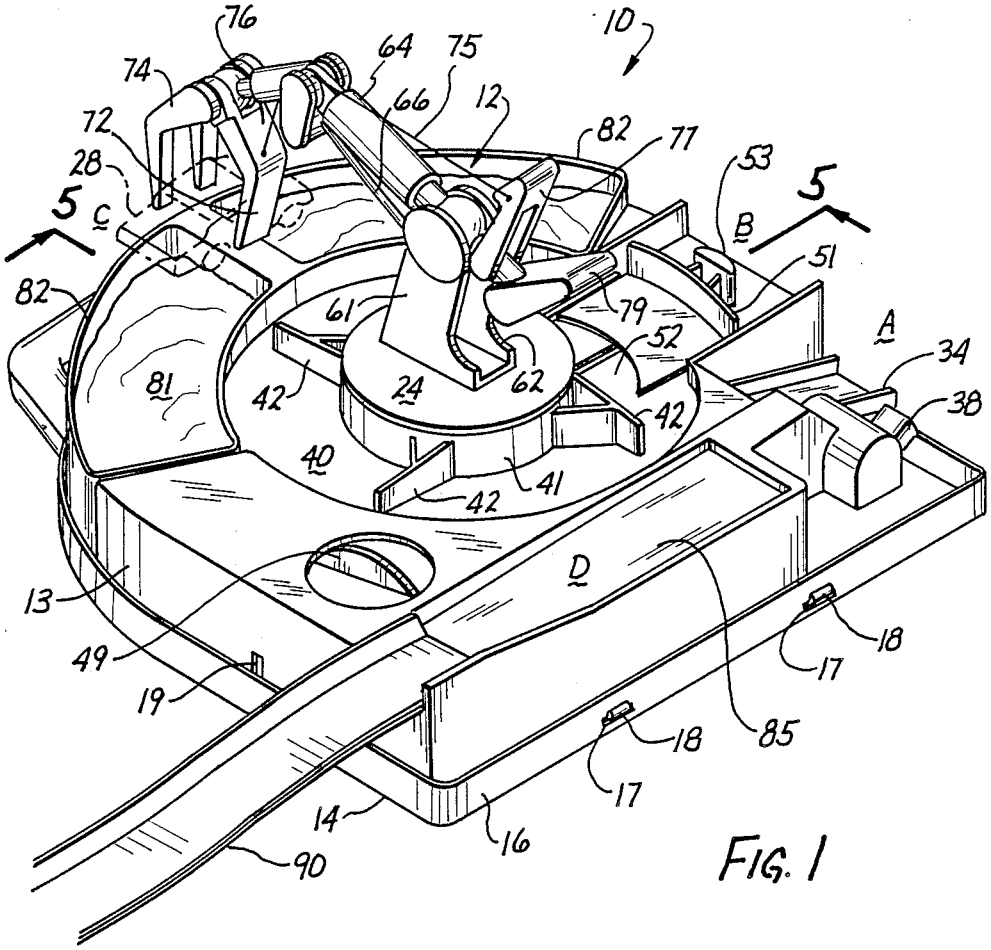
FIG. 1
FIG 4
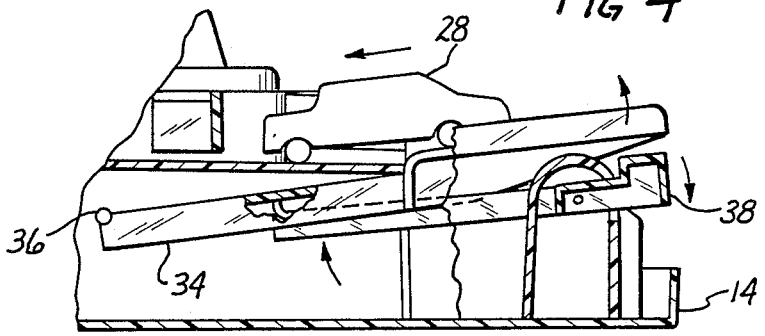

FIG. 3
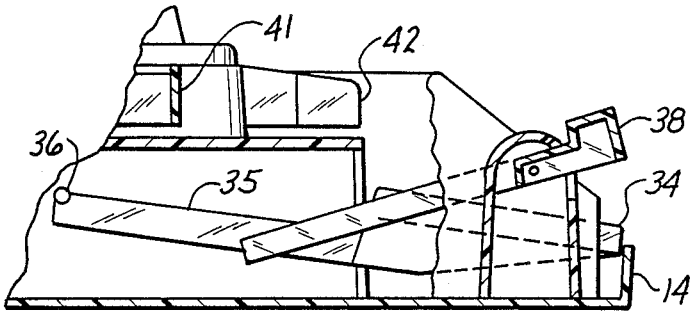
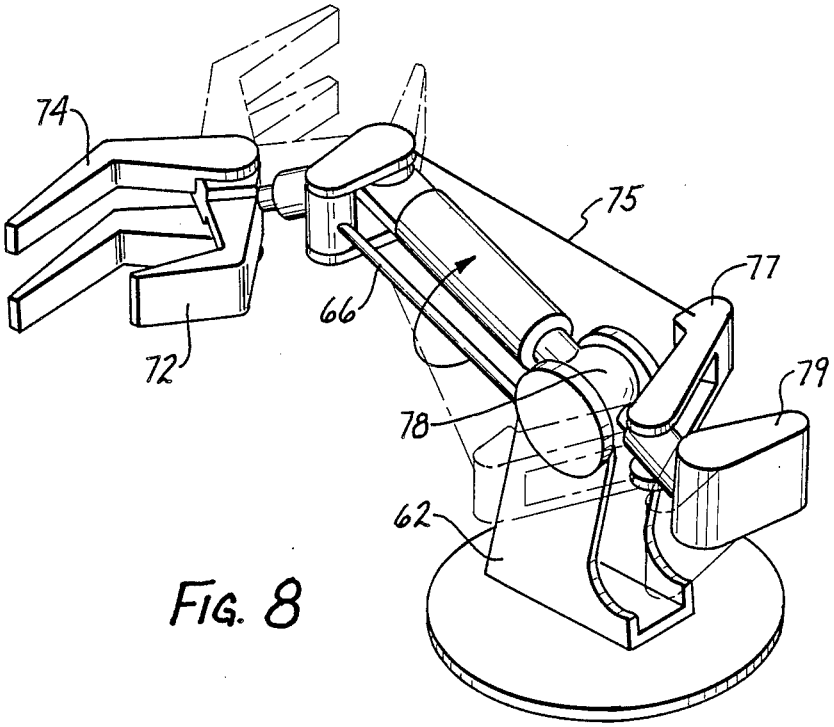
FIG. 8

TOY APPARATUS INCLUDING ROBOTIC ARM

BACKGROUND OF THE INVENTION

1. Field of the Invention

This invention relates to a playset having a robotic arm apparatus for handling toy members, such as toy vehicles, and, in particular, to an apparatus for handling toy vehicles advanced along a track in seriatum enabling a variety of operations to be performed by a child.

2. Prior Art

U.S. Pat. No. 2,429,070 to Olson shows a toy crane for transporting marbles to be loaded and unloaded.

U.S. Pat. No. 2,563,974 to Thierry shows a toy excavator.

U.S. Pat. No. 3,911,615 to Alexander shows a toy scoop loader with a manual control for opening and closing a bucket.

U.S. Pat. No. 3,955,312 to Pugh shows a doll having a hand secured thereto which is capable of gripping or holding an object.

U.S. Pat. No. 3,997,061 to Sano shows a toy crane enabling a child to select three modes of operation by manipulation of a control member into one of three positions.

U.S. Pat. No. 4,150,839 to Tucker et al. shows a riding toy including a grasping mechanism including a pair of operable jaw members.

U.S. Pat. No. 4,186,517 to Kuhn et al. shows a doll with arm actuated fingers.

U.S. Pat. No. 4,208,830 to Yoshida shows a mechanical hand amusement device consisting of a moveable grip member joined by a rod extending to a hand member for control thereof.

U.S. Pat. No. 4,236,344 to Kelly shows a toy with spring-operated speed regulated motor mechanism in the form of a construction wheel loader having a shovel.

U.S. Pat. No. 4,312,149 to Iwao shows a transfer mechanism utilizing a pivotable holding member for use in a toy.

U.S. Pat. No. 4,315,650 to Yoshida shows a mechanical hand amusement device.

U.S. Pat. No. 4,507,043 to Flatau shows a counterbalance robot arm.

U.S. Pat. No. 4,626,164 to Chang shows a robot with improved transmission system.

SUMMARY OF THE INVENTION

A primary aspect of the present invention is a toy apparatus in a playset including a robotic arm module for handling toy members, such as toy vehicles in which the toy vehicles are advanced along a predetermined path past a plurality of stations including a pickup station, an immersion station, and an exit station. The robotic arm module has gripper members actuatable for picking up the toy vehicle at the pickup station, then dipping the vehicle into a liquid and then depositing the toy vehicle at an exit station. The robotic arm module is in the form of a parallelogram and includes an upper arm portion pivotable on a universal joint and a lower arm portion having universal joints at each end to effect twisting movement of the gripper member to dip the toy vehicle at either end at the option of the child operator.

Another aspect of the invention is the housing for the toy apparatus which defines the track or path where the toy vehicles are advanced in seriatum by the operator who is controlling the robotic arm module. The housing is defined to accommodate the components of the playset including toy vehicles for storage and has a cover member with handle to facilitate carrying the playset. The track has a rotatable member for advancing the toy vehicles from an entry station towards the pickup station.

BRIEF DESCRIPTION OF THE DRAWINGS

FIG. 1 is a perspective view of the toy playset apparatus incorporating a robotic arm apparatus according to the present invention;

FIG. 3 is an exploded side sectional view of the playset taken along lines 3—3 of FIG. 2 illustrating certain details thereof;

FIG. 4 is a view similar to FIG. 3 illustrating the operation of loading a toy vehicle;

FIG. 8 is an exploded view of the robotic arm apparatus illustrating twisting action thereof.

DETAILED DESCRIPTION OF THE PREFERRED EMBODIMENT

Figure 2:
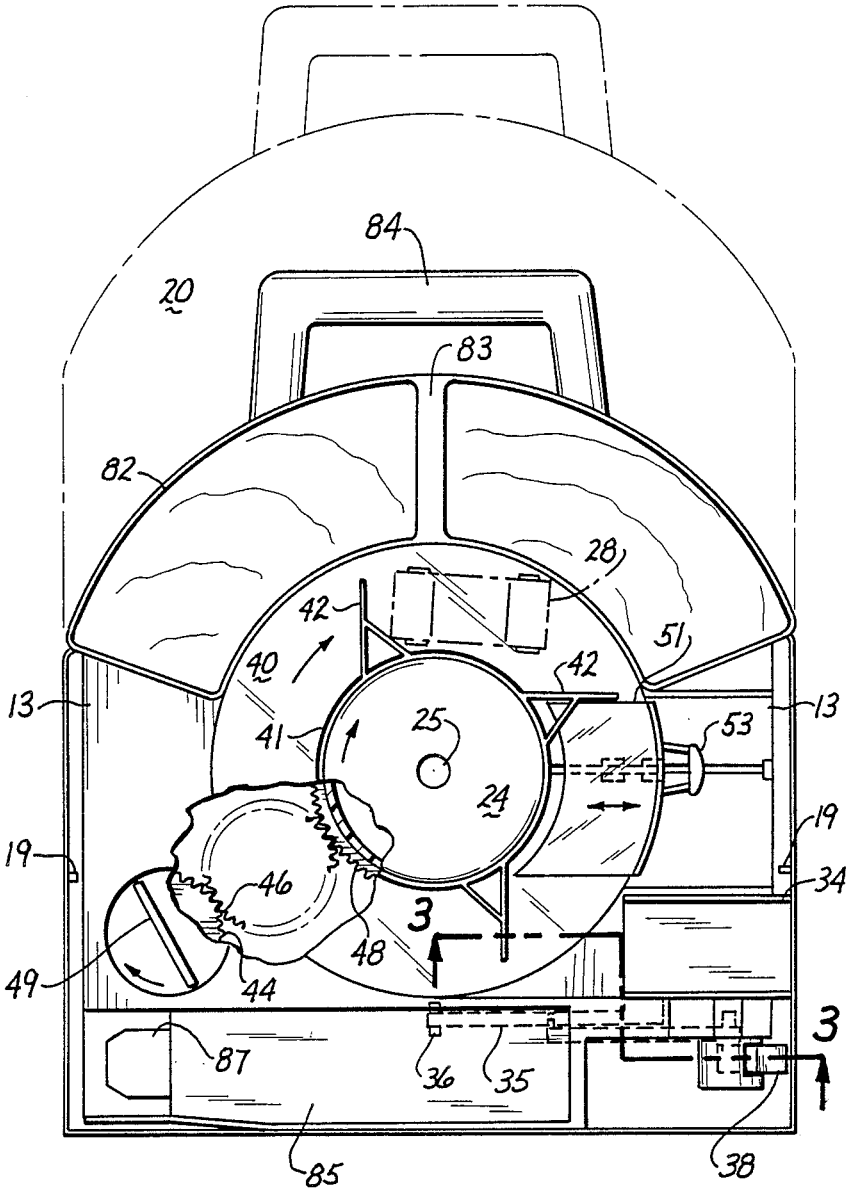
FIG. 2 is a plan view of the toy playset apparatus.

Referring to FIG. 1, there is shown a toy playset 10 incorporating a robotic arm apparatus 12 for handling toy members, such as, toy vehicles, to be dipped into a liquid and advanced along a track. Playset 10 includes a housing 13 and a cover member 14 having a handle portion 15 (FIG. 5) and a peripheral wall portion 16. Wall portion 16 has a plurality of slots 17 to receive protrusions 18 extending from housing 13 to provide a complementary snap fit. Housing 13 is formed with slots 19 to receive that side of the linear wall portion 16 which is opposite to handle portion 15. By this structure, cover member 14 is moveable to provide a parking area 20 (FIG. 2) for the toy members or a cover for housing 13 as desired. It should be noted that the housing 13 is hollow to accommodate toy members and components of the playset for storage.

Supported at the center of the housing 13 is a robotic arm apparatus 12 which is a modular unit and used for handling and transporting toy members 28 (FIG. 4), such as toy vehicles that are advanced in seriatum along the track defined by the housing. The robotic arm apparatus 12 is positioned on housing 13 on a support surface 24 (FIG. 2) which has an opening 25 formed therein to receive a post member 27 (FIG. 5) extending from the robotic arm module to enable pivoting of the robotic arm apparatus 12 on the axis of post member 27.

The robotic arm apparatus 12 is used to handle the toy vehicles 28 as the vehicles are advanced along a path. Each vehicle 28 is lifted from a car pickup station and dipped into a liquid and then deposited at a vehicle exit station as will be more fully understood hereinafter. The purpose for immersing the toy vehicles in the liquid is to effect a color change as the temperature varies due to the vehicle being painted with a paint containing thermochromic material. The color changing feature using thermochromic material does not form a part of the present invention. The liquid is either warm or cold to cause a change in temperature of the thermochromic material and, as a result, a change in color of the vehicle. A more detailed explanation of the thermochromic material and the color change process is described in co-pending application Ser. No. 07/067,519 filed June 26, 1987, entitled Toy Vehicle with Thermochromic Material. The instant invention is concerned with the handling of the toy vehicle by the robotic arm apparatus in ccnjunction with the various stations along the path of the toy vehicles by the operator of the playset 10.

To commence the play operation, each of the toy vehicles is loaded onto a track or path for handling by the robotic apparatus. Referring to FIGS. 2–4, a toy vehicle 28 is positioned onto a ramp member 34 at a car entry station generally designated A. Ramp member 34 has an offset extending portion 35 which is pivotable on a pin member 36 upon depressing an actuating lever 38 which engages portion 35. When ramp member 34 is urged upwardly by lever member 38, the toy vehicle 28 is advanced towards an annular track section 40. The toy vehicles 28 are advanced around track section 40 by moving annular member 41 having extension members 42 for pushing the vehicles. Annular member 41 is driven by rotatable gear member 44 which engages rotatable gear member 46 which, in turn, drives rotatable gear member 48 supporting annular member 41. It will be appreciated that a handle member 49 positioned on gear member 44 is used for turning action to move the annular member 41 advancing the vehicle 28 along a circular path towards a pickup station.

At a car pickup station generally designated B is a slidable member 51 positioned on housing 13 in overlying relation to the path of the vehicle. Member 51 receives a toy vehicle 28 from the path and positions the vehicle 28 outwardly at a predetermined position at the pickup station B for pickup by the robotic arm apparatus 12. Member 51 is guided in its path by a slot opening 52 formed in housing 13. A handle member 53 extending from member 51 facilitates the sliding action for moving the vehicle 28 to the pickup station B and returning the slidable member 51 to the vehicle path.

Figure 5:
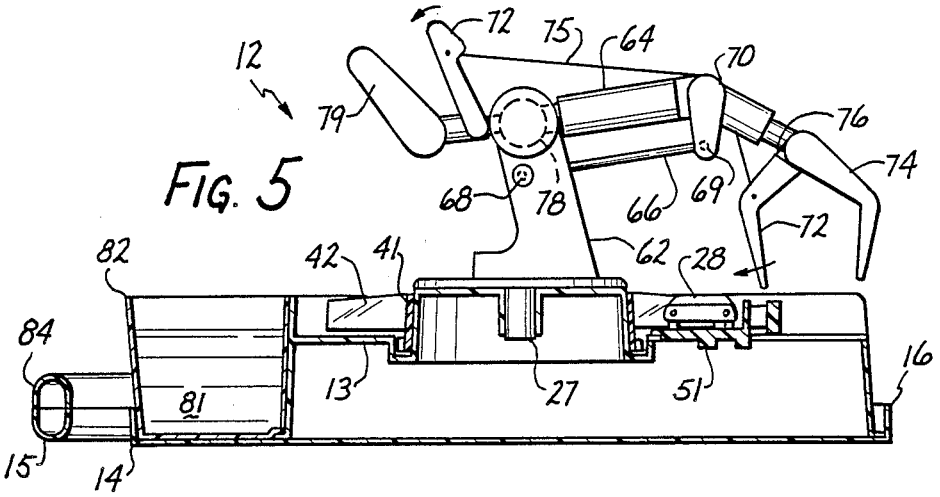
FIG. 5 is a side sectional view of the toy playset taken along lines 5—5 of FIG. 1.
Figure 6:
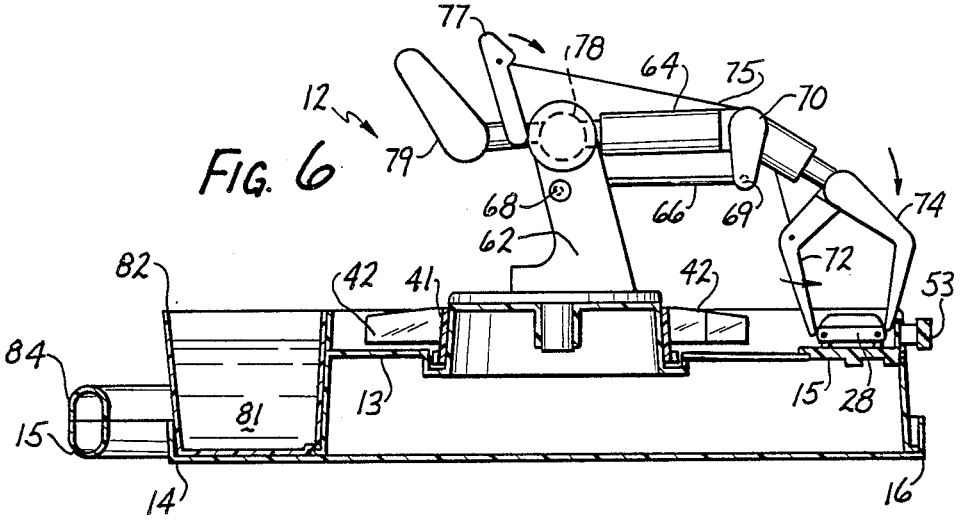
FIG. 6 is a side sectional view similar to FIG. 5 illustrating a different sequence of operation of the robotic arm apparatus.
Figure 7:
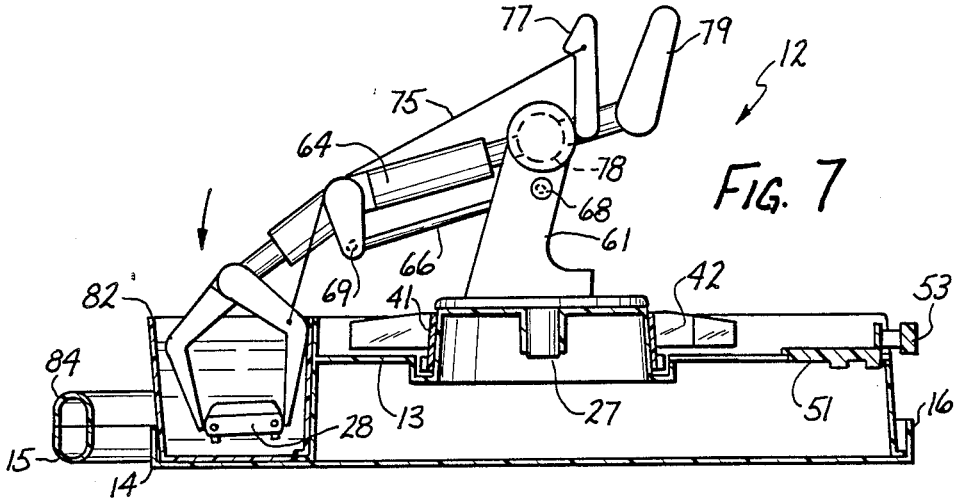
FIG. 7 is a side sectional view similar to FIGS. 5 and 6 illustrating another sequence of operation of the robotic arm apparatus.

Referring to FIGS. 1 and 5–7, robotic arm apparatus 12 is positioned at the center of the annular track section 40 on support member 24. Apparatus 12 includes a base support including base members 61 and 62 which serve to support upper arm member 64 and lower arm member 66. Lower arm member 66 has a pair of universal joints 68 and 69 formed at each end thereof (FIG. 5). Universal joint 68 is received by the support members 61 and 62. Universal joint member 69 is received by outer arm member 70 which has claw members 72 and 74 secured thereto. Claw member 72 is pivotably mounted to move relative to claw member 74 to provide the necessary gripping action. Claw member 72 is movable by a flexible link 75 and is actuatable by a trigger member 77 against the biasing of a spring member 76 coiled on the pivot axis of claw member 72. Upper arm member 64 has a universal joint 78 formed therein that is received by support members 61 and 62.

It will be appreciated that upper arm member 64 and lower arm member 66 together with the universal joints 68, 69, and 78 and arm member 70 form a moveable parallelogram linkage that may be controlled from control member 79. By this structure, the robotic arm apparatus may be raised and lowered about a horizontal axis as well as twisted about the longitudinal axis of the apparatus, thereby allowing the operator to selectively lower either the front end or rear end of the toy vehicle 28 into the liquid as desired. See FIG. 8. Due to the support by the post member 27, the robotic arm apparatus can easily be rotated on a vertical axis to transport vehicles in a horizontal path between stations. It should be noted that the universal joints 68, 69 and 78 are made of very low coefficient of friction material. Any suitable material can be used. Preferred materials are DELRIN 500, a trademark of Dow Chemical Corp. and CELCON, a trademark of the Celanese Corp.

Upon lifting a vehicle at station B (FIG. 6), the operator transports the vehicle toward the immersion station C (FIG. 7) at which are positioned one or more containers 82 which contain a suitable liquid 81 for the color change process such as warm or cold water. The containers 82 can be molded from a unitary member made of plastic with a connector portion 83 (FIG. 2) supported by housing 13. The containers 82 are provided with a handle portion 84. Handle portion 84 mates with handle portion 15 of cover member 14 to facilitate carrying the playset.

After the vehicle is lowered into the liquid at immersion station C, the vehicle is then transported to a vehicle exit station D (FIG. 1) where the vehicle 28 is released from the gripper members of the robotic arm apparatus onto a track surface 85. A ramp member 90 (FIG. 1) extends from a tongue portion 87 (FIG. 2) extending the track surface 85 for exiting a toy vehicle 28 from the housing of the playset. The operation is repeated for a number of toy vehicles advanced along the path of the playset to provide color change to the vehicles for amusement by the child operator. Upon termination of play, the vehicles and components are stored in the playset housing 13 which may be covered by cover member 14 and easily transported from place to place.

The above description discloses the preferred embodiment of the present invention. However, persons of ordinary skill are capable of numerous modifications once taught these principles. Accordingly, it will be understood by those skilled in the art that changes in form and details may be made without departing from the spirit and scope of the invention.

What is claimed is:

1. Toy apparatus including a robotic arm for handling toy members, comprising:

a housing;

a track positioned on the housing for defining a predetermined path past a plurality of stations including a pickup station, an immersion station, and an exit station, and a robotic arm positioned on said housing, said robotic arm having a first elongated member having a major axis and including actuatable gripper members pivotally coupled to the distal end and a control member at the proximal end;

a first pivot including a first universal joint supporting first elongated member to be pivotable on a first axis for vertical movement and rotatable about its major axis; and a second pivot supporting said first elongated member to be pivotable on a second axis for movement in a horizontal plane, whereby said gripper members can be controlled to pick up a toy member at the pickup station and dip the toy member at the immersion station, and deposit the toy member at the exit station.

2. Apparatus according to claim 1 wherein said first universal joint is made of very low coefficient of friction material.

3. Apparatus according to claim 2 wherein said robotic arm includes a second elongated member having first and second ends coupled to said first pivot and said actuatable gripper members by second and third universal joints respectively and wherein said first and second elongated members are supported to form parallel sides of a parallelogram whereby twisting movement may be imparted to the gripper members to selectively dip the toy member at the ends thereof at the option of an operator.

4. Apparatus according to claim 3 wherein said immersion station includes at least one container of liquid at a predetermined temperature to cause a change in the color of the toy member.

5. Apparatus according to claim 1 wherein said track includes a rotatable member to advance each toy member form an entry station towards the pickup station.

6. Apparatus according to claim 5 including a pivotably ramp member at the entry station actuatable for lifting a toy member and advancing the toy member towards the rotatable member.

7. Apparatus according to claim 1 wherein said gripper members are configured to receive toy members which are toy vehicles.

8. Apparatus according to claim 1 wherein said immersion station includes a plurality of containers, each containing a liquid at a different temperature sufficient to cause a change in the color of the toy member.

9. Apparatus according to claim 1 wherein said exit station includes a ramp member to exit each toy member from the housing.

10. Apparatus according to claim 1 wherein said housing is hollow to define a storage area for the toy members and rotobic arm.

11. Apparatus according to claim 10 including a cover member having a handle for carrying the toy apparatus.

12. Apparatus according to claim 1 wherein said housing has a plurality of slots formed therein and including a cover member having a peripheral wall that in a first position has the wall received by said slots and in a second position has the wall coextensive with the housing to define a container.

13. Robotic arm apparatus for handling toy members, comprising:

a frame;

a first arm member having actuatable gripper members disposed at the distal end and a control member disposed at the proximal end thereof;

a first universal joint pivotally securing said first arm member to said frame;

a second arm member extending parallel to said first arm member and having first and second ends;

a second universal joint connecting said first end to said frame;

a third universal joint connecting said second end to said distal end of said first arm member, whereby a twisting movement may be imparted to the gripper members thereby twisting the toy member at the option of an operator.

14. Apparatus according to claim 13 wherein said universal joints are made of very low coefficient of friction material.

* * * * *